US005172646A

United States Patent [19]

Masters

[11] Patent Number: 5,172,646

[45] Date of Patent: Dec. 22, 1992

[54] CANOE WITH ASYMMETRICAL HULL

[76] Inventor: William E. Masters, 100 Bentcreek Ct., Easley, S.C. 29642

[21] Appl. No.: 728,693

[22] Filed: Jul. 11, 1991

[51] Int. Cl.[5] ..... B63B 35/00

[52] U.S. Cl. ..... 114/347; 114/56

[58] Field of Search ..... 114/56, 57, 355, 356, 114/347

[56] References Cited

FOREIGN PATENT DOCUMENTS 359304 3/1906 France ..... 114/56

57486 3/1986 Japan ..... 114/355

*Primary Examiner*—Jesus D. Sotelo

*Attorney, Agent, or Firm*—Cort Flint

[57] ABSTRACT

A watercraft such as a canoe and the like which is propelled by paddling is disclosed that can be paddled on one side and propelled generally in a straight line. The watercraft includes an asymmetrical hull which is asymmetrical along its length and also from side to side. There is a larger volume on one side of the longitudinal center line of the hull than the other. A keel line defined by the bottommost portion of the hull forms a sinuous path from the bow to the stern. For a right handed paddler, the large volume is on the starboard side in the bow section of the hull, and is on the port side in the stern section of the hull. The keel line changes over at a transition section which is symmetrical from the port to the starboard side. The paddling position is slightly aft of the transition section with a paddler properly positioned, the craft may be propelled generally in a straight line by paddling only on the right side, and the craft may be turned left to right by leaning forward and rearward, respectively.

13 Claims, 2 Drawing Sheets

CANOE WITH ASYMMETRICAL HULL

BACKGROUND OF THE INVENTION

The invention relates to watercraft such as canoes and kayaks which are propelled by paddling and, more particularly, to a hull design which facilitates paddling of the watercraft in a given direction with a paddle stroke on one side of the craft only.

Heretofore, the paddling of canoe and kayak type watercraft as required the performance of paddle strokes on both sides of the craft. Furthermore, handling of the craft in turns, particularly in whitewater and competitive sports conditions, requires skillful and coordinated paddle strokes.

Accordingly, an object of the present invention is to provide a watercraft of the canoe an kayak type which has an asymmetrical hull so that it may be paddled generally in a straight direction with paddle strokes on one side of the craft only. Another object of the invention is to provide an asymmetrical hull for a canoe and the like watercraft wherein the craft may be turned by leaning forward and rearward to change the configuration of the hull in the water and turn in a desired direction for more skillful handling in whitewater and competitive sports.

SUMMARY OF THE INVENTION

The above objectives are accomplished according to the present invention by providing a hull which is asymmetrical. The hull has a larger volume on one side of the center line than the other. The canoe is paddled on the side which has the larger volume in the bow section of the hull. The paddle strokes on that side are compensated for by the hull configuration and the craft travels generally in a given direction. The asymmetrical hull undergoes a transition at a medial transition section where the larger volume of the hull changes to the other side in the stern section. If the canoeist leans forward, the configuration of the hull in the water changes causing the canoe to turn in one direction. If the canoeist leans rearward, the change of the hull configuration in the water causes the boat to turn in the opposite direction. In this manner, the craft may be easily maneuvered and powered by paddle strokes on one side of the craft only.

The asymmetrical hull has an asymmetrical configuration from the bow to the stern, and an asymmetrical configuration from the port side to the starboard side of the hull. The asymmetrical configuration defines a keel line at the bottommost portion of the hull which has a sinuous shape from the bow to the stern. The hull has a larger volume on the first side of the center line than on the second side of the center line. The watercraft turns into a paddle stroke when paddled only on the first side which causes the angular velocity of the paddle stroke to cancel the effect of the watercraft to veer to the first side and travel generally in a straight line. The asymmetrical hull has an asymmetrical bow section and an asymmetrical stern section. A boater may lean forward from a neutral position to change the proportions of the bow and stern hull sections below the waterline to turn the watercraft in a first direction, and may lean rearward to turn the watercraft in a second direction. The asymmetrical hull includes a transition section between the bow and stern sections which is symmetrical from a starboard to a port side of the hull. A neutral position from which the craft is paddled is slightly aft of a longitudinal center of the hull. The bow and stern sections have different length and different asymmetrical characteristics.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, a watercraft is illustrated which incorporates an asymmetrical hull, designated generally as A, according to the invention. While the invention may have application generally to any type of hull that is paddled, it has particular advantage to a watercraft such as a canoe or kayak which is paddled. The term "canoe" as commonly used herein is meant to be inclusive of those watercraft which are typically paddled from a kneeling position. The drawings illustrate asymmetrical hull A in a configuration for a right handed paddler "B". It is to be understood, of course, that hull A may be configured for a left handed paddler.

Figure 1:
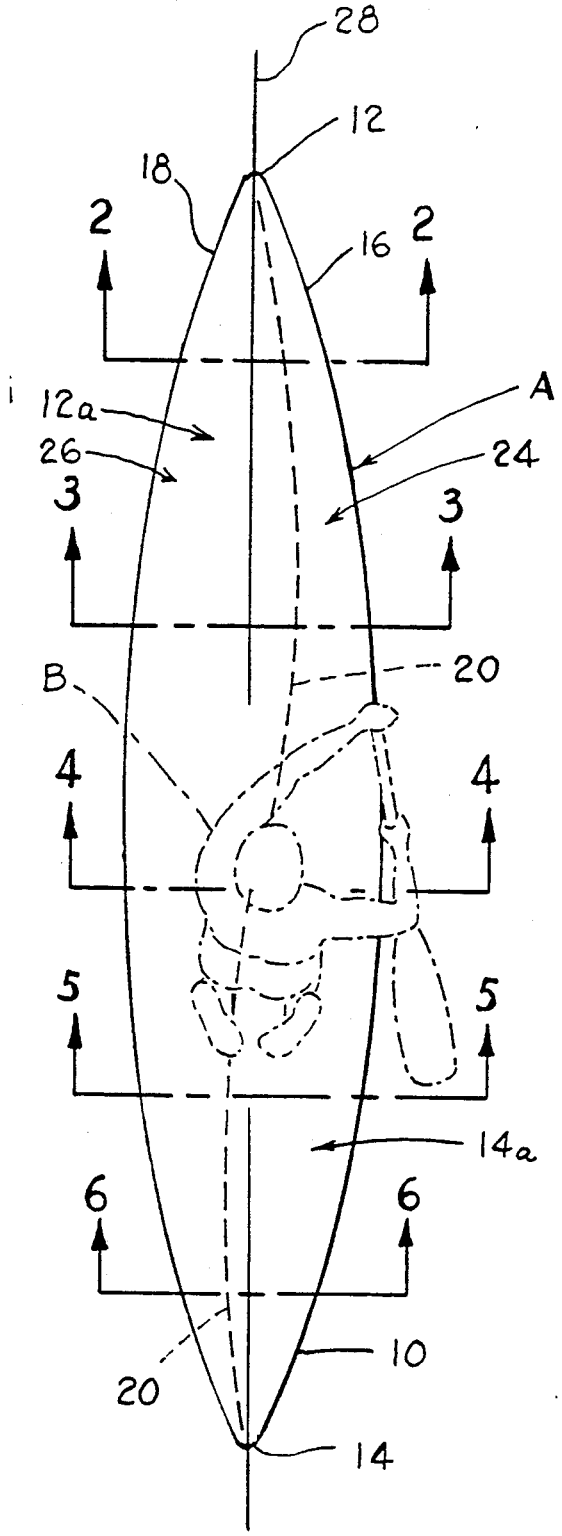
FIG. 1 is a top plan view of a watercraft incorporating an asymmetrical hull according to the invention.
Figure 2:
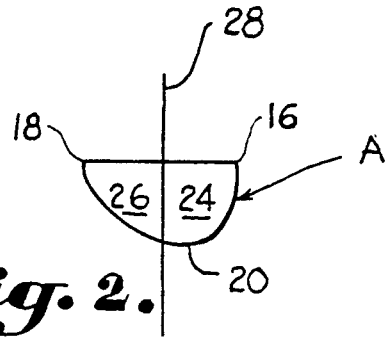
FIG. 2 is a sectional view taken along line 2—2 of FIG. 1.
Figure 3:
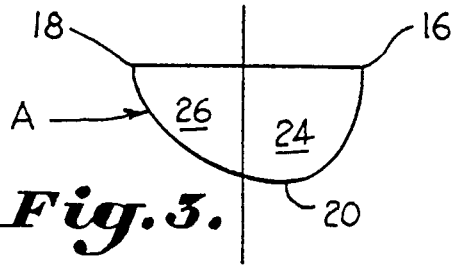
FIG. 3 is a sectional view taken along line 3—3 of FIG. 1.
Figure 4:
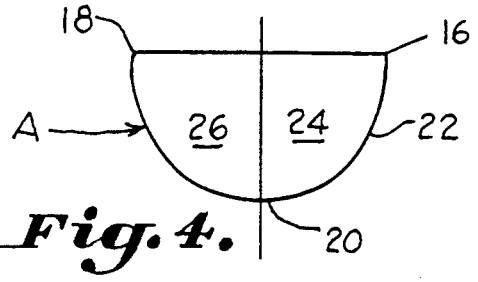
FIGS. 4 is a sectional view taken along line 4—4 of FIG. 1.
Figure 5:
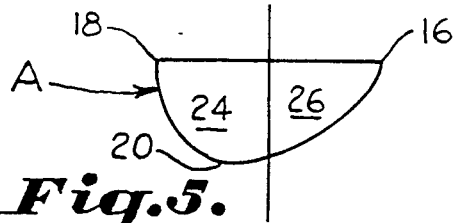
FIG. 5 is a sectional view taken along line 5—5 of FIG. 1.
Figure 6:
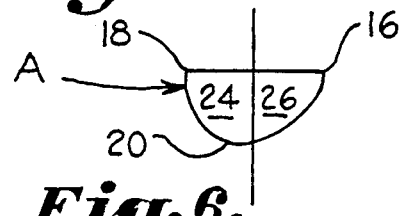
FIG. 6 is a sectional view taken along line 6—6 of FIG. 1.
Figure 7:
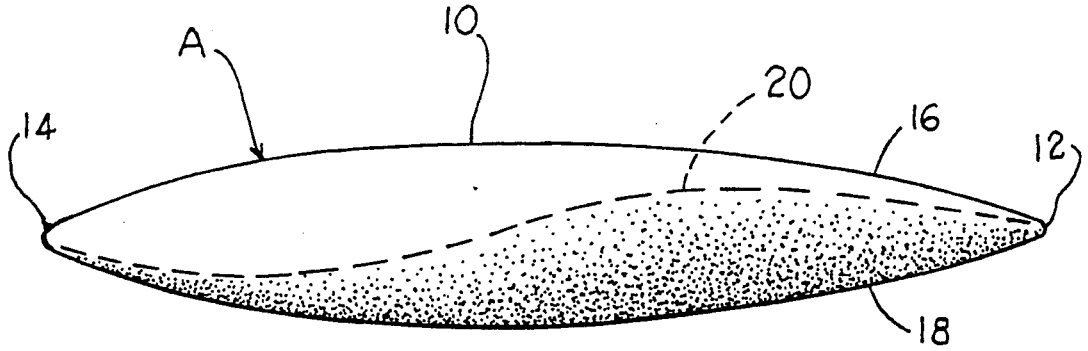
FIG. 7 is a bottom plan view of a watercraft incorporating an asymmetrical hull according to the invention.

As can best be seen in FIG. 1, a canoe 10 is illustrated incorporating asymmetrical hull A which varies in symmetry from a bow 12 to a stern 14, as well as varies from a first, starboard side 16 to a second, port side 18. Hull A is configured so that a keel line 20, defined by the bottommost portion of the hull, is generally sinuous. There is a transition section 22 about which the hull is symmetrical from side to side.

As illustrated in the preferred embodiment for a right handed paddler, there is a larger volume, designated generally as 24, and a smaller volume, designated generally as 26, in a bow section **12*a* of the hull. Larger volume 24 is on the first or starboard side (right) 16 of the hull and smaller volume 26** is on the second or port side 18 of the hull. Because of the drag of the larger volume 24 in the water, there is a natural tendency for asymmetrical hull A to veer to the right. In a symmetrical hull, a right handed paddle stroke causes the craft to veer to the left. Asymmetrical hull A automatically veers into the paddle stroke and the paddle stroke causes the canoe to go straight, the paddler being properly positioned in the canoe. When paddled on the right, canoe 10 will automatically turn into the paddle stroke. The angular vector of the paddle stroke cancels the effect of the canoe to veer to the right. The asymmetrical configuration of hull A can best be seen in FIGS. 2–6. Forward of transition section 22, the larger hull volume 24 is on the right of center line 28, and the smaller volume 26 is on the left of the center line. Aft of transition section 22, larger volume 24 is on the left of the center line and smaller volume 26 is on the right.

With the canoeist in a kneeling position, as can best be seen in FIG. 1, the canoeist is properly positioned near transition section 22, slightly aft of the middle of the canoe, to paddle the kayak on the right side. As the canoeist strokes the paddle only on the right side of the canoe, the asymmetrical hull compensates for the paddle stroke so that the craft tends to go straight. The asymmetrical design of the hull from starboard to port counteracts paddling on a single side of a canoe and is particularly good for lake canoeing where paddling is usually done in a straight line. The side to side asymmetrical configuration of the hull allows the boat to be more efficient. The same counteracting effect to turning can be had with a rudder, but at a high cost and efficiency due to the drag of the rudder.

Figure 8:
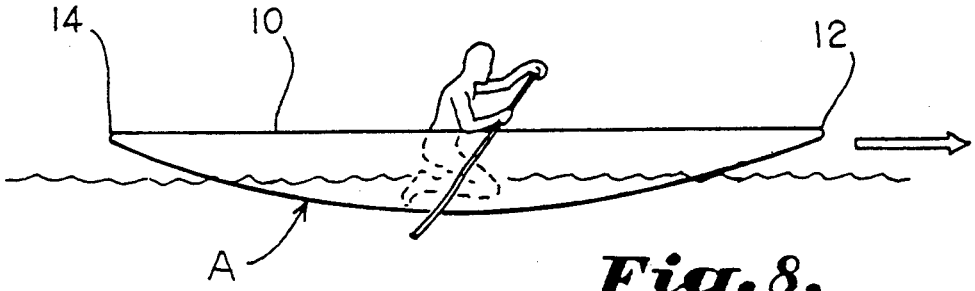
FIG. 8 is a side view from the starboard side of a watercraft having an asymmetrical hull.
Figure 9:
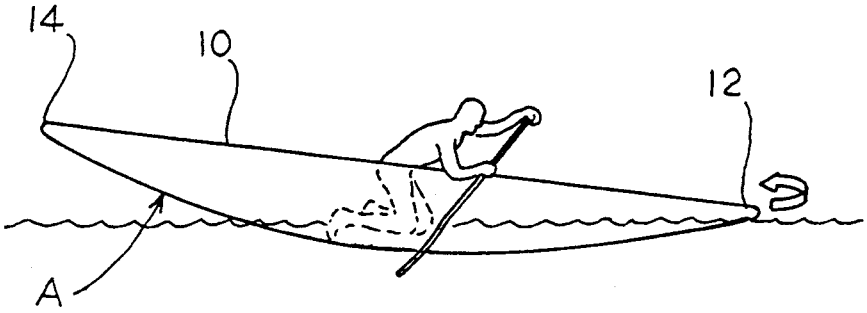
FIG. 9 is a side view from the starboard side of a watercraft having an asymmetrical hull illustrating the change in direction of the craft caused by changing the hull configuration in the water.
Figure 10:
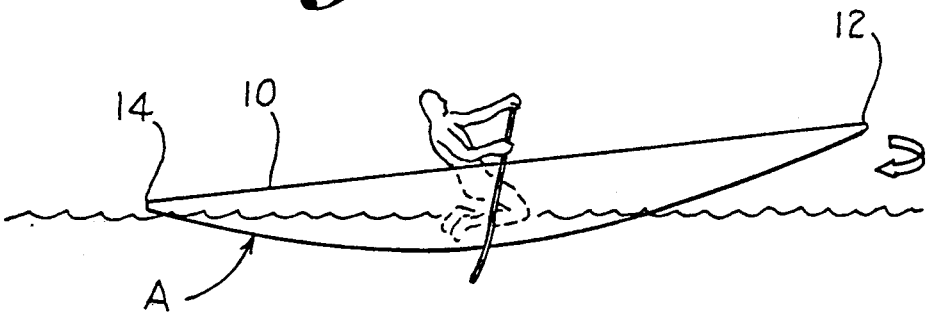
FIG. 10 is a side view from the starboard side of a watercraft having an asymmetrical hull illustrating the change in direction of the craft caused by changing the hull configuration in the water.

Another major advantage of asymmetrical hull A is for a whitewater canoe or kayak. As can best be seen in FIG. 8, whitewater watercraft typically have a rocker 30 defined by the curvature from the bow end 12 to the stern end 14 of the craft. For example, U.S. Pat. No. 4,480,579 discloses an adjustable rocker and discusses the effect of the rocker of a kayak type craft. The effect of the kayak rocker is well known. According to the present invention, a paddler can shift their weight fore and aft to change that portion of the hull, and the configuration of the hull, below the water line. Due to the configuration of asymmetrical hull A in bow and stern sections 12*a* and 14*a*, respectively, the changing configuration of the hull in the water causes the boat to turn in one direction or the other. For example, with the canoeist in a kneeling position as shown in FIG. 9, the canoe can be turned to the left by the canoeist leaning forward in the canoe. This changes the portion of the hull below the water line. The asymmetrical design of that portion of the hull below the water line will cause the boat to turn to the left. If the canoeist leans rearward, the portion of the hull below the water line will again change, and due to the asymmetrical hull, will turn the craft to the right (FIG. 10).

Thus, it can be seen that an advantageous hull construction can be had for a canoe and the like according to the invention wherein the canoe can be paddled from one side only to power the craft in a given direction, and the craft can be turned in a given direction merely by shifting the weight of the canoeist.

While a preferred embodiment of the invention has been described using specific terms, such description is for illustrative purposes only, and it is to be understood that changes and variations may be made without departing from the spirit or scope of the following claims.

What is claimed is:

1. A watercraft comprising:

an asymmetrical hull having a bow and a stern, a first side and a second side defined on either side of a longitudinal center line of said hull;

said asymmetrical hull having an asymmetrical configuration from said bow to said stern, and an asymmetrical design from said port side to said starboard side of said hull; and said asymmetrical configuration defining a keel line at the bottommost portion of said hull having a sinuous shape from said bow to said stern, said hull having a larger volume on said first side of said center line than on said second side of said center line;

whereby said watercraft turns into a paddle stroke when paddled only on said first side thereby causing the angular velocity of the paddle stroke to cancel the effect of the watercraft to veer to said first side and travel generally in a straight line.

2. The watercraft of claim 1 wherein said asymmetrical hull includes an asymmetrical bow section and an asymmetrical stern section and a transition section defined between said asymmetrical bow and stern sections;

whereby said boater may lean forward from a neutral position to change the proportions of said bow and stern sections of said hull below the waterline to turn said watercraft in a first direction and may lean rearward to turn said watercraft in a second direction.

3. The watercraft of claim 2 wherein said neutral position is slightly aft of a longitudinal center of said hull.

4. The watercraft of claim 2 wherein said hull includes a bow section and a stern section fore and aft of said transition section, and said bow and stern sections have a different length and different asymmetrical characteristics.

5. The watercraft of claim 1 wherein said asymmetrical hull includes a transition section which is symmetrical from a starboard to a port side of said hull.

6. The watercraft of claim 5 wherein said hull includes a bow section and a stern section fore and aft of said transition section, and said bow and stern sections have a different length and different asymmetrical characteristics.

7. The watercraft of claim 1 wherein said larger volume and said first side are on a starboard side of said hull for a right handed paddler.

8. A watercraft which may be paddled on one side only to travel in a given direction comprising:

a hull having a bow and a stern, and a port side and a starboard side on opposing sides of a longitudinal center line of said hull;

said hull having an asymmetrical bow section which is asymmetrical along its length and from said port side to said starboard side;

said hull having an asymmetrical stern section which is asymmetrical along its length and from said starboard side to said port side;

said asymmetrical bow section having a larger volume on one side of said watercraft with regards to said longitudinal center line; and said asymmetrical hull includes a transition section between said bow and stern sections which is symmetrical from a starboard to a port side of said hull;

whereby said watercarft turns into a paddle stroke when paddled only on said one side thereby causing the angular velocity of the paddle stroke to cancel the effect of the watercraft to veer to said one side and travel generally in a straight line.

9. The watercraft of claim 8 wherein said asymmetrical bow section and asymmetrical stern sections have different asymmetrical characteristics so that said boater may lean forward from a neutral position to change the proportions of said bow and stern hull sections below the waterline to turn said watercraft in a first direction and may lean rearward to turn said watercraft in a second opposite direction.

10. The watercraft of claim 9 wherein said neutral position is slightly aft of said transition section.

11. The watercraft of claim 8 wherein said larger volume and said one side are on a starboard side of said hull for a right handed paddler.

12. A watercraft which can be propelled in a given direction by paddling one side only comprising:

a hull having a bow and a stern, and a first side and a second side defined on either side of a longitudinal center line of said hull;

said hull having an asymmetrical configuration from said first side to said second side; and said bow having a larger volume on a first side of said center line than on a second side of said center line; and said stern having a larger volume on said second side of said center line than on said first side of said center line;

whereby said watercraft turns into a paddle stroke when paddled only on said first side thereby causing the angular velocity of the paddle stroke to cancel the effect of the watercraft to veer to said first side and travel generally in a straight line.

13. The watercraft of claim 12 wherein said larger volume and said first side are on a starboard side of said hull for a right handed paddler.

* * * * *